US005356029A

United States Patent [19]

Hogan

[11] Patent Number: 5,356,029

[45] Date of Patent: Oct. 18, 1994

[54] BIN-TYPE BULK FLUID CONTAINER

[75] Inventor: Christopher T. Hogan, Houston, Tex.

[73] Assignee: Kaneka Texas Corporation, Houston, Tex.

[21] Appl. No.: 111,389

[22] Filed: Aug. 25, 1993

[51] Int. Cl.[5] ..... B65D 5/50; B65D 5/56

[52] U.S. Cl. ..... 220/465; 222/105; 222/183; 229/122.1

[58] Field of Search ..... 229/122.1; 220/462, 220/464, 465; 222/105, 183, 564

[56] References Cited

U.S. PATENT DOCUMENTS

| | | | |
|---|---|---|---|
| 2,556,661 | 6/1951 | Rendall et al. | 229/122.1 |
| 2,831,610 | 4/1958 | Dennie | 222/183 |
| 2,973,119 | 2/1961 | Parker | 220/464 |
| 3,081,003 | 3/1963 | Baxter et al. | 222/105 |
| 3,172,570 | 3/1965 | Lipschutz | 220/465 |
| 3,325,058 | 6/1967 | West, Jr. | 222/183 |
| 3,785,534 | 1/1974 | Smith | 220/465 |
| 4,120,420 | 10/1978 | Dirksing | 220/462 |
| 4,342,405 | 8/1982 | Croley | 222/564 |
| 4,548,351 | 10/1985 | Gusic | 229/122.1 |
| 4,836,418 | 6/1989 | Dinslage | 222/105 |

FOREIGN PATENT DOCUMENTS

| | | | |
|---|---|---|---|
| 2163741 | 3/1973 | Fed. Rep. of Germany | 222/564 |
| 9116246 | 10/1991 | PCT Int'l Appl. | 220/465 |

OTHER PUBLICATIONS

"It Pays to be Compatible, " *Packaging Digest,* Jun., 1992.

Clements & Wellner, "Plastic Lined Fiber Bins Replace Metal/Plastic Drums," *Food Processing,* Apr., 1988.

Mans, "Showcase: Aseptic Packaging," *Prepared Foods,* Mar., 1988.

Henderson, "More Choices in Bulk Liquid Containers," *CPI Purchasing,* Dec., 1986.

Brochures, Plas-weld, Inc. of Ontario, Canada, 1989.

Brochure, MacMillan Bloedel Bulk Packaging, Marietta, Ga., 1989.

Brochure, Arena Products, Inc., Rochester, N.Y., 1991.

Article, "Corrugated Shipper Cuts Waste," *Food and Drug Packaging,* Jan. 1993.

Brochure, Boise Cascade of Louisville, Ky., 1989.

Brochure, MacMillan Blodel Bulk Packaging, Marietta, Ga., 1991.

Brochure, LinPac, Inc., Atlanta, Ga., 1992.

Brochure, Longview Fibre Co., Portland, Oreg, 1998.

*Primary Examiner*—Gary E. Elkins

*Attorney, Agent, or Firm*—Willian Brinks Hofer Gilson & Lione

[57] ABSTRACT

An improvement in a bin-type, bulk fluid container. The container comprises a rigid carton containing a plastic bag. The bag has an evacuation element on its side adjacent its bottom. The bag rests on a wedge shaped insert in the carton. The insert comprises a body molded in one piece from relatively dense, expanded plastic. The insert includes an upper panel supported by walls and partitions between the walls.

12 Claims, 2 Drawing Sheets

BIN-TYPE BULK FLUID CONTAINER

FIELD OF THE INVENTION

This invention relates to bin-type, bulk fluid containers. It relates particularly to a bin-type bulk fluid container with an evacuation orifice at the bottom of the bin.

BACKGROUND OF THE INVENTION

Bin-Type bulk liquid containers are generally used for the storage and transportation of large quantities of liquids. The containers comprise a rigid carton, usually constructed of corrugated cardboard or other lightweight fiber or paper materials, and are manufactured in standard sizes: 55 gallon, 110 gallon, 220 gallon, 275 gallon, 300 gallon, and 330 gallon capacities. The dimensions of the containers allow for mounting on standard-sized, rectangular loading pallets. These bulk containers offer substantial economic advantages over traditional metal drums or barrels because the bulk containers weigh less and are made from recyclable materials. Furthermore, the containers are manufactured in interlocking geometric sizes and shapes which simplify storage and minimize wasted storage space. For instance, intermediate size bulk containers may be stacked several units high. These advantages lead to lower freight rates, manufacturing ease, ease of operation, lower overall costs, and substantial space savings.

A bulk container for storing or transporting liquids also conventionally comprises a polyethylene bag placed within the rigid carton to hold the liquid product. The bag normally has a spigot, valve, or sealed tube molded into its side to permit evacuation of the liquid from the filled bag. When the bag is positioned inside the carton, this evacuation element projects through a small opening or orifice in the side of the carton, near the bottom.

The carton effectively causes the liquid-filled polyethylene bag to conform to the shape of the carton. The bag is susceptible to rupture during transport, however, due to inertial movement or "splashing" of the liquid within the bag. The hydraulic energy of the liquid during movement sometimes causes the bag to stretch and crack. This problem is more significant when the bag is filled with liquids that are not too viscous.

The polyethylene bag is subject to increased stretching and an increased possibility of rupture if an air space is left between the filled bag and the top of the carton. The fluid transport and storage industry deals with this problem by filling this air space with dunnage to absorb some of the hydraulic energy of the liquid. The dunnage used is lightweight and compressible, and prevents the fluid-filled bag from shifting significantly during transportation. The most commonly used dunnage products are sealed-air foam, which is foamed into the headspace at the time the bag is filled with liquid, or 1.6 to 2.3 density foam sheeting cut to fit the space.

As previously pointed out, an evacuation element in the form of a spigot, valve or tube is used to drain liquid from the container. The element is connected to the polyethylene bag within the carton, and is usually positioned on a side wall close to a bottom edge. In order to protect the structural integrity of the container and minimize the possibility of leakage and damage to the evacuation element, the element is usually mounted a short distance above the bottom.

Because of the position of the evacuation element, complete product evacuation cannot be achieved without moving the container. The container must be tipped forward, toward the element, in order to drain the liquid which remains in the bag below the level of the element. Moving the container in this fashion is inconvenient to the user, especially when the container is of a larger size. Moreover, tipping the container forward is nearly impossible if containers are stacked several high. Unstacking them to drain them reduces the economic advantage offered by this storage configuration, i.e., adds to the otherwise low costs which are a significant advantage of bulk containers. Finally, if all the liquid product in the bag is not drained, the user incurs a substantial amount of waste. In the larger bulk container sizes, 10 to 20 gallons of liquid may remain in the bottom of the bag if the container is not tipped.

BRIEF SUMMARY OF THE INVENTION

It is an object of the present invention to provide an improvement in a bin-type, bulk fluid container which assures thorough evacuation of fluid from the container.

It is another object to provide an improvement in a bin-type, bulk fluid container which protects against flex cracking of the polyethylene bag during transportation of the filled container.

It is another object to provide an improvement in a bin-type, bulk fluid container which includes a lightweight insert in the bottom of the container.

It is still another object to provide an improvement in a bin-type, bulk fluid container including an inexpensive and easily disposable, or recyclable, insert.

The invention is embodied in a bin-type, bulk fluid container including a carton containing a fluid tight, plastic bag. Supporting the bag within the carton is an insert which rests on the floor of the carton. The insert has a plan configuration corresponding to the inside shape of the carton. This plan configuration is conventionally square or octagonal.

The insert is generally wedge shaped and, in a preferred form, has a bag support surface made up of three surface sections, each of triangular shape in plan. The three surfaces form a composite support surface which slopes downwardly from an outer edge, along three sides of the insert, which is between 125 and 175 mm high, to a central point adjacent the fourth side, which is 45 mm high. At this point a drain well depression is formed in the insert. The bag has an evacuation element which passes through that depression and out of an orifice in the side wall of the carton.

The insert comprises a body molded in one piece from relatively dense polypropylene in the embodiment described. It includes an upper panel on which the support surface is formed. The upper panel is supported by four walls and a series of partitions between and extending parallel to two side walls. A cross-brace connects the side walls and partitions.

BRIEF DESCRIPTION OF THE DRAWINGS

The invention, including its construction and method of operation, is illustrated more or less diagrammatically in the drawings, in which.

DESCRIPTION OF THE PREFERRED EMBODIMENTS

Figure 1:
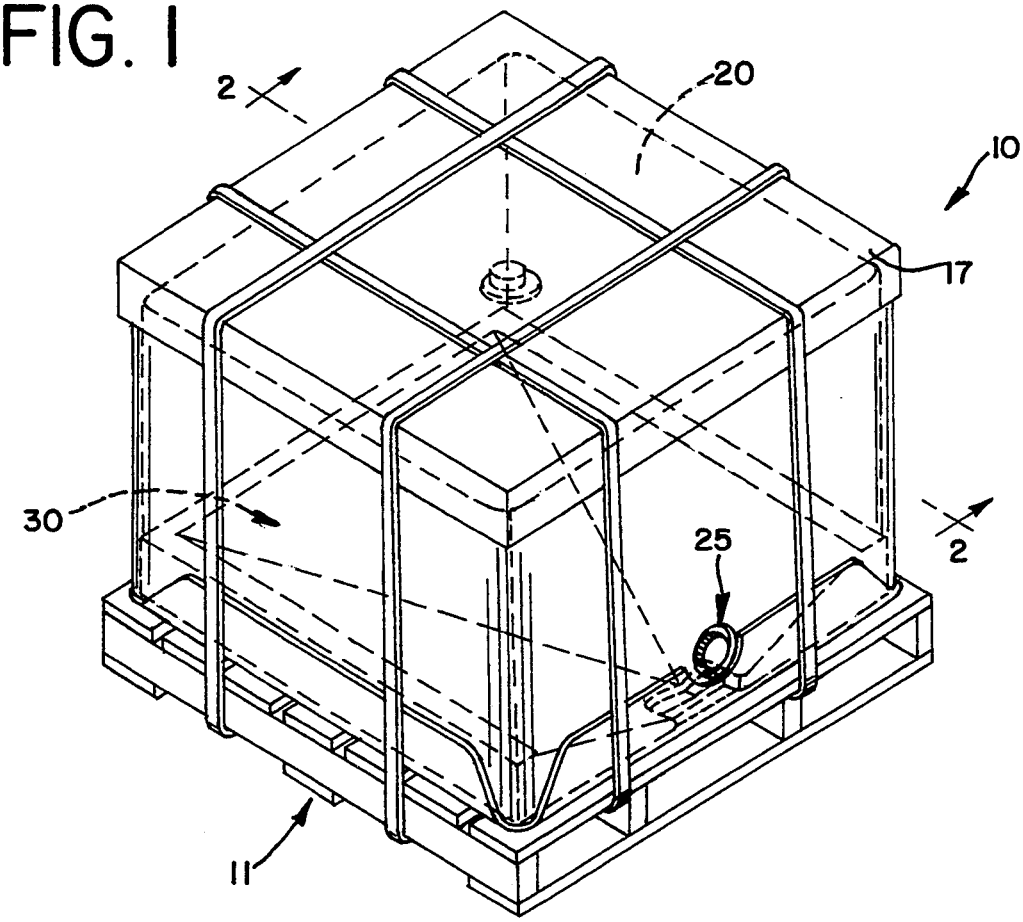
FIG. 1 is a perspective view of an improved bulk fluid container embodying features of the present invention.
Figure 2:
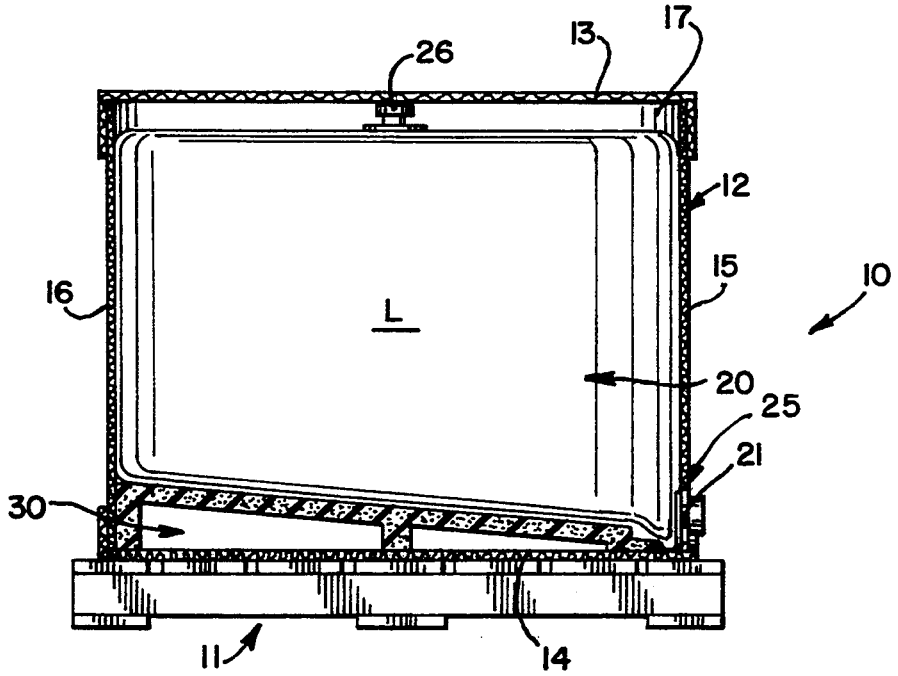
FIG. 2 is a vertical sectional view taken along line 2—2 of FIG. 1.

Referring now to the drawings, and particularly to FIGS. 1 and 2, a bin-type, bulk fluid container embodying features of a preferred form of the present invention is seen generally at 10. The container 10 is shown resting on a conventional wooden pallet 11. In this form of the invention, the container 10 has a square cross-section.

The container 10 includes a heavy paper-board carton 12 of standard configuration having a top wall 13, bottom wall 14, front wall 15, rear wall 16, and side walls 17. The container also includes a bulk fluid bag 20 inside the carton 12. In use, as shown the bag 20 is filled with liquid L. An evacuation element in the form of a capped spigot 21 is attached to the bag 20 near its bottom. The spigot 21 projects through an orifice 25 in the front wall 15 of the carton 12. A filling port and cap 26 are provided on top of the bag 20.

Supporting the bag 20 within the carton 12 is an insert 30 which also embodies features of the invention. The insert 30 is molded in a single body of expanded polyethylene or polypropylene plastic. In the specific form shown, EPERAN, a proprietary expanded polyethylene product of Kaneka Texas Corporation, Houston, Tex., is employed.

Referring now to FIGS. 3–6, the molded plastic insert 30 body is shown in greater detail. It includes a roof-panel 32. The roof panel 32 comprises three panel sections 33, 34 and 35, which are each triangular in shape and inclined to the horizontal. It also includes a border section 36 which surrounds the panel sections 33, 34 and 35 on three sides, and is horizontal. The upper surface 37 of the roof-panel 32 supports the bag 20 in the box 12.

The roof-panel 32 is supported by an upstanding back panel 41, a front panel 42, two side panels 43, a plurality of partition panels 44 extending parallel to the side panels 43, and a cross-brace panel 45 connecting the side panels 43 and partition panels 44. The roof panel sections 33, 34 and 35 are each inclined downwardly from their juncture with corresponding wall panels 41 or 43 to where they meet along juncture lines 51 and 52 in the upper surface 37 of the roof panel 32.

Figure 5:
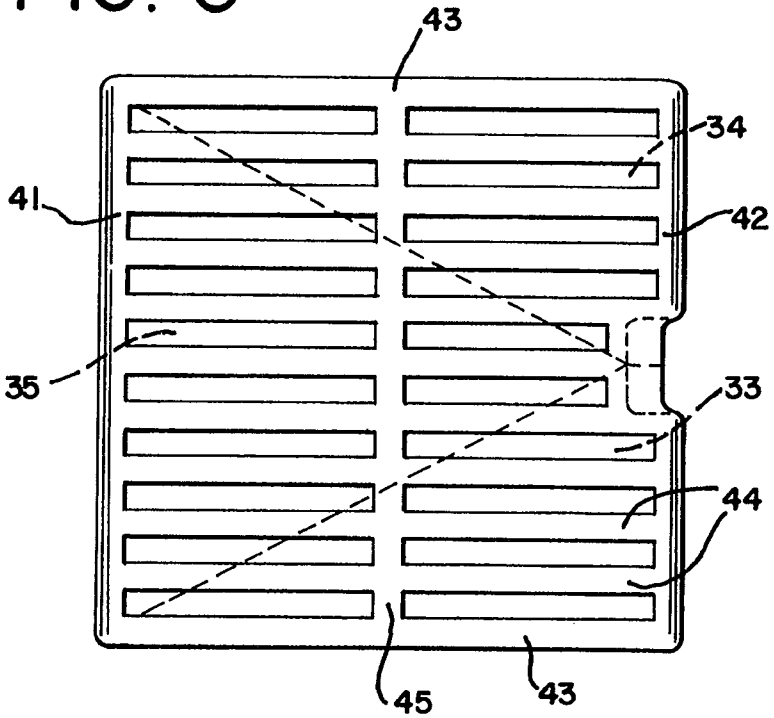
FIG. 5 is a bottom plan view of the insert.
Figure 6:
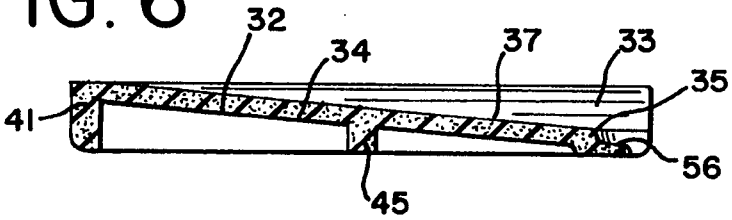
FIG. 6 is a vertical sectional view taken along line 6—6 of FIG. 3.
Figure 3:
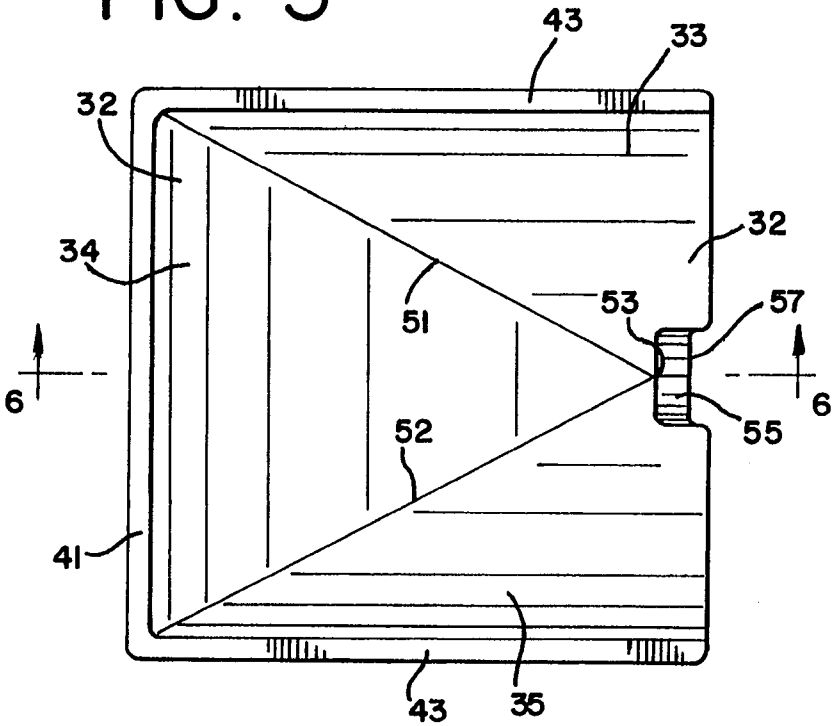
FIG. 3 is a top plan view of an insert for the container of FIG. 1.
Figure 4:
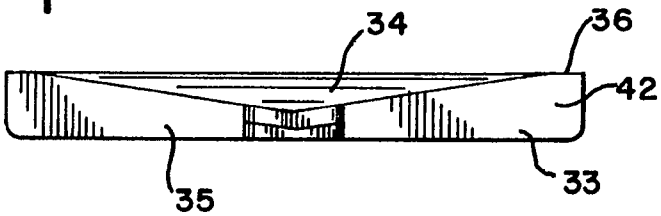
FIG. 4 is a front end view of the insert.

The juncture lines 51 and 52 converge to a point 53 in the upper surface 37 of the roof panel 32 immediately adjacent a cut-out 55 in the roof panel and the front panel 42. At that point 53 the panel surface 37 is 45 mm high. The cut-out 55 forms a slightly vee-shaped ledge 56, spaced below the level of the upper surface 37 at the point 53. At its low point the ledge 56 is 15 mm high. The front edge 57 of the ledge 56 is also recessed inwardly from the outer periphery of the front panel 42, as seen in FIGS. 3, 5 and 6.

On the upper 37 surface of the roof panel 32, over the border section 36, where the surface is horizontal, the insert 30 illustrated is 175 mm high. The border section 36 is 40 mm wide. From that border section 36, the surface 37 over each of the panel sections 33 and 35 is inclined downwardly and toward the other panel section at an angle of 20° to the horizontal. In contrast, the surface 37 over the panel section 34 is inclined downwardly and toward the front panel 42 at an angle of 15°. As a result, the juncture lines 51 and 52 in the surface 37 converge at an angle of 60° to each other and are inclined 15° to the horizontal.

The surface 37 on the panel 32 is, as has been pointed out, supported on the wall, partition and brace panels 41, 42, 43, 44 and 45. In the preferred embodiment, the panel 32 has a minimum thickness of 30 mm. The back panel 41, front panel 42, cross-brace panel 45, and side wall panels 43 are at least 50 mm thick. The partition panels 44 are 51 mm thick and spaced 50 mm apart. The cut-out 55 is 100 mm wide, from front to back. The ledge is 60 mm wide from front to back, and 180 mm long. It has been found that these dimensions provide optimum strength with minimum weight and material usage for the plastic used.

Referring again to FIGS. 1 and 2, the bag 20 filled with liquid L is shown supported on the surface 37 of the insert 30. The spigot 21 of the bag 20 is positioned above the bottom of the bag and protrudes out of the orifice 25 in the front wall 15 of the carton 12. The portion of the bag 20 adjacent and below the spigot 21 rests in, and is supported by, the ledge 56 in the cut-out 55 of the insert 30.

With the bag 20 filled to capacity, which in the illustrated container 10 is 55 gallons, the filler port and cap 26 is positioned immediately adjacent the top 13 of the carton 12. A minimum amount of dunnage (not shown) needs to be employed to fill the little space which remains above the bag 20 and below the removable top wall 13 of the carton 12.

The container 10 filled with liquid L is transported in this way on the loading pallet 11. Containers 10 and pallets 11 may be stacked several layers high when received by the user. Nevertheless, each container can be fully emptied without tipping the container forward toward its spigot 21.

Using the improved container 10 of the present invention, virtually no liquid remains in the bag 20 after the spigot 21 is opened and the liquid L permitted to gravity drain. The insert 30 which assures this drainage causes all liquid L to flow toward the spigot 21, where it descends into a well created by the cut-out 55 and ledge 56 adjacent the spigot. As a result, only a small amount (measured in pints or quarts rather than gallons) of liquid L can collect below the level of the spigot 21, whereby it will not drain without tipping the container.

The insert 30 illustrated and described in this preferred embodiment of the invention is 175 mm high at its side and back panels 43 and 41, as has been pointed out. In an alternative form of this preferred embodiment, it is 125 mm high. All the other dimensions remain the same, however. The alternative form finds application with lower viscosity liquids.

While a preferred embodiment of the invention has been described, it should be understood that the invention is not so limited and modification may be made without departing from the invention. The scope of the invention is defined by the appended claims, and all devices that come within the meaning of the claims, either literally or by equivalence, are intended to be embraced therein.

What is claimed is:

1. A foam plastic insert for use in a bin-type, bulk fluid container including a carton having a bottom wall, sidewalls upstanding from the bottom wall, and an evacuation orifice on a sidewall, said insert comprising:

a) a molded plastic foam body adapted to fit inside said carton and on said bottom wall;
b) said body including a roof panel having a support surface on top of it;
c) said roof panel being supported by a plurality of wall panels.

2. The insert of claim 1 further characterized in that:
a) said body is molded in one piece of a foam plastic;
b) said roof panel being inclined downwardly from each of a plurality of said wall panels.

3. The insert of claim 2 further characterized in that:
a) said roof panel includes a plurality of panel sections;
b) at least two of said panel sections being inclined relative to the horizontal and relative to each other.

4. The insert of claim 3 further characterized in that:
a) a cut-out is formed in said roof panel and one of said wall panels.

5. The insert of claim 4 further characterized by and including:
a) a support surface on said roof;
b) said cut-out defining a ledge below said support surface.

6. The insert of claim 3 further characterized in that:
a) said wall panels extend between 125 mm and 175 mm vertically from said bottom wall.

7. The insert of claim 6 further characterized in that:
a) said body is molded in one piece from an expanded plastic taken from a group comprising polyethylene and polypropylene.

8. The insert of claim 7 further characterized in that:
a) said roof panel is at least 30 mm thick; and
b) said wall panels are at least 50 mm thick.

9. In a bin-type, bulk fluid container wherein the container includes a carton having a bottom wall, and a top wall interconnected by side walls, an orifice is formed in one of the walls adjacent the bottom wall of the carton and a bag for holding fluid is disposed within said carton and has a drainage element in the side of the bag adapted to fit through the orifice, the improvement comprising:
a) a removable insert mounted in said carton underneath said bag;
b) said insert having a support surface on which said bag rests;
c) said support surface includes a surface section inclined downwardly toward said orifice;
d) said support surface having a shape effective to deform said bag so as to cause liquid in said bag to flow by gravity toward said drainage element;
e) said insert being made from a material selected from the group including a foam polymer and molded plastic.

10. The insert of claim 9 further characterized in that:
a) said foam polymer is selected from the group including polyethylene and polypropylene.

11. In a bin-type, bulk fluid container wherein the container includes a carton having a bottom wall, and a top wall interconnected by side walls, an orifice is formed in one of the walls adjacent the bottom wall of the carton and a bag for holding fluid is disposed within said carton and has a drainage element in the side of the bag adapted to fit through the orifice, the improvement comprising:
a) a removable insert mounted in said carton underneath said bag;
b) said insert having a support surface on which said bag rests;
c) said support surface including a plurality of panel sections inclined downwardly at different angles toward said orifice;
d) said support surface having a shape effective to deform said bag so as to cause liquid in said bag to flow by gravity toward said drainage element;
e) said insert being made from a material selected from the group including a foam polymer and molded plastic.

12. The insert of claim 11 further characterized in that:
a) said foam polymer is selected from the group including polyethylene and polypropylene.

* * * * *